US009150341B2

(12) United States Patent
Fuisz

(10) Patent No.: US 9,150,341 B2
(45) Date of Patent: Oct. 6, 2015

(54) UNIT ASSEMBLY AND METHOD OF MAKING SAME

(75) Inventor: Richard C. Fuisz, McLean, VA (US)

(73) Assignee: MonoSol Rx, LLC, Warren, NJ (US)

( * ) Notice: Subject to any disclaimer, the term of this patent is extended or adjusted under 35 U.S.C. 154(b) by 133 days.

(21) Appl. No.: 12/873,834

(22) Filed: Sep. 1, 2010

(65) Prior Publication Data

US 2011/0056934 A1 Mar. 10, 2011

Related U.S. Application Data

(60) Provisional application No. 61/239,179, filed on Sep. 2, 2009.

(51) Int. Cl.
*B65D 75/06* (2006.01)
*B65D 75/12* (2006.01)
*B65D 75/20* (2006.01)

(52) U.S. Cl.
CPC ..... *B65D 75/06* (2013.01); *B65D 75/12* (2013.01); *B65D 75/20* (2013.01); *B65D 2575/586* (2013.01)

(58) Field of Classification Search
CPC ..... A45D 33/005; B65D 31/02; B65D 31/10; B65D 31/12; B65D 33/007; B65D 33/1691; B65D 33/2533; B65B 3/0022; B65B 9/02; B65B 9/06; B65B 9/087; B65B 11/30
USPC ..... 220/6, 666; 493/162; 383/35, 95, 105, 383/120, 203; 229/87.05, 210
See application file for complete search history.

(56) References Cited

U.S. PATENT DOCUMENTS

| | | | | | |
|---|---|---|---|---|---|
| 218,650 | A | * | 8/1879 | Weaver | 383/89 |
| 1,743,681 | A | * | 1/1930 | Neuman | 206/299 |
| 3,570,751 | A | * | 3/1971 | Trewella | 383/207 |
| 4,648,509 | A | * | 3/1987 | Alves | 229/164.1 |
| 4,705,174 | A | * | 11/1987 | Goglio | 383/210 |
| 4,787,517 | A | * | 11/1988 | Martin | 383/203 |
| 5,326,576 | A | * | 7/1994 | Zuege | 426/107 |
| 5,364,189 | A | * | 11/1994 | Kuge et al. | 383/61.2 |
| 5,407,278 | A | * | 4/1995 | Beer | 383/38 |
| 5,770,839 | A | * | 6/1998 | Ruebush et al. | 219/727 |

(Continued)

FOREIGN PATENT DOCUMENTS

WO 2005102863 A1 11/2005

OTHER PUBLICATIONS

Notification of Transmittal of the International Search Report and the Written Opinion of the International Searching Authority, or the Declaration for PCT/US2010/047561 mailed on Nov. 22, 2010 (3 pages).

(Continued)

*Primary Examiner* — Bryon Gehman
*Assistant Examiner* — Brijesh V. Patel
(74) *Attorney, Agent, or Firm* — Hoffman & Baron, LLP

(57) ABSTRACT

The present invention provides a unit assembly for storing and dispensing a film strip. The unit assembly includes a first and second panel each having a perimetrical edge; wherein the first and second panels are substantially opposed to each other; and at least one gusseted side panel disposed between at least a portion of the panels along a common side thereof, the gusseted side panel configured to facilitate access to at least one film strip which is stored in a perimetrically sealed, substantially planar cavity within the unit assembly.

19 Claims, 8 Drawing Sheets

(56) References Cited

U.S. PATENT DOCUMENTS

| | | | | |
|---|---|---|---|---|
| 5,814,382 | A * | 9/1998 | Yannuzzi, Jr. | 428/34.3 |
| 6,292,400 | B1 * | 9/2001 | Dozza et al. | 365/185.25 |
| 6,478,216 | B2 * | 11/2002 | Wiart | 229/101 |
| 6,726,054 | B2 * | 4/2004 | Fagen et al. | 221/45 |
| 6,865,860 | B2 * | 3/2005 | Arakawa et al. | 53/412 |
| 6,929,400 | B2 * | 8/2005 | Razeti et al. | 383/66 |
| 7,014,363 | B2 * | 3/2006 | Hanson | 383/120 |
| 7,036,713 | B2 * | 5/2006 | Lee | 229/116 |
| 7,223,017 | B2 * | 5/2007 | Weaver | 383/63 |
| 7,665,896 | B1 * | 2/2010 | Higgs | 383/100 |
| 2002/0177380 | A1 | 11/2002 | Forman et al. | |
| 2003/0106900 | A1 * | 6/2003 | Storz | 221/259 |
| 2004/0159571 | A1 * | 8/2004 | Fagen et al. | 206/461 |
| 2004/0208400 | A1 * | 10/2004 | Linneweil | 383/68 |
| 2006/0073190 | A1 | 4/2006 | Carroll et al. | |
| 2006/0191984 | A1 * | 8/2006 | Hitosugi | 229/112 |
| 2006/0285781 | A1 * | 12/2006 | Zoss | 383/120 |
| 2007/0170196 | A1 | 7/2007 | Libohova et al. | |
| 2008/0073235 | A1 * | 3/2008 | Harada et al. | 206/449 |
| 2008/0230426 | A1 * | 9/2008 | Asmussen et al. | 206/499 |
| 2008/0265009 | A1 * | 10/2008 | Katoh | 229/117.16 |
| 2008/0296360 | A1 * | 12/2008 | Abel et al. | 229/137 |
| 2009/0196907 | A1 * | 8/2009 | Bunick et al. | 424/439 |
| 2010/0142858 | A1 * | 6/2010 | Kruse et al. | 383/5 |

OTHER PUBLICATIONS

International Search Report for PCT/US2010/047561 mailed on Nov. 22, 2010 (4 pages).

Written Opinion of the International Searching Authority for PCT/US2010/047561 mailed on Nov. 22, 2010 (5 pages).

* cited by examiner

UNIT ASSEMBLY AND METHOD OF MAKING SAME

CROSS-REFERENCE TO RELATED APPLICATION

This application claims the benefit of U.S. Application No. 61/239,179, filed Sep. 2, 2009, the entire contents of which are herein incorporated by reference.

FIELD OF THE INVENTION

The present invention relates generally to a package structure for storing a film strip. Specifically, the package structure may be gusseted to promote efficient and effective opening of the package structure and removal of the film strip therein.

BACKGROUND OF THE INVENTION

Pharmaceuticals and similar substances are typically required to be ingested in relatively precise amounts. One technique for delivering precise pharmaceutical doses for ingestion or topical administration in precise amounts is to incorporate into a dissolvable film strip with the relatively precise amount of the pharmaceutical. The user simply ingests the dissolvable film strip to receive the pharmaceutical dosage.

Film strips containing medicaments may be contained within a package structure for storage before ingestion or application by the user. Such package structures may desirably provide protection to the film strip and maintain the pharmaceutical or medication in a contaminant-free, controlled environment before ingestion or application thereof by the user. The package structures are typically opened by the user manually tearing the packet to gain access to the film strip therein.

Current package structures that are manually tearable typically require a tear away portion to remove a large edge of the package that is sufficiently large to open the cavity of the package structure in which the film strip is contained. However, the size of the removed edge section must be precise, and if too large, it may be detrimental to the film strip. Tearing is imprecise and often results in either an area that is too small to effectively remove the film, or the tearing of the package is not controllable and results in the film also getting torn. Moreover, packages for such film are generally small and flat and even when torn are difficult to open and remove the film contained therein. There is a need for a film package which is easily opened in a controllable fashion and which alleviates the risks of film damage and difficulties with taking the film from the package which are attendant current package designs.

SUMMARY OF THE INVENTION

The present invention provides a unit assembly for storing and dispensing a film strip. The unit assembly includes a package structure having a first and second panel, each panel having a perimetrical edge; wherein the first and second panels are substantially opposed to each other; and at least one gusseted side panel disposed between at least a portion of the panels along a common side thereof, the gusseted side panel configured to facilitate access to at least one film strip which is stored in a perimetrically sealed, substantially planar cavity within the unit assembly.

The present invention also provides a method of manufacturing a unit assembly for housing a film strip. The method of manufacturing further includes the steps of: folding a package structure into a configuration having a first panel and a second panel, each having a perimetrical edge substantially opposed to each other and at least one gusseted side portion disposed between at least a portion of the first and the second panel along a common side thereof, wherein the package structure defines a cavity therein; inserting at least one film strip into the package structure to define a unit assembly; and closing the unit assembly to enclose the at least one film strip therein to yield a plurality of gripping elements, wherein the unit assembly is configured to protect the at least one film strip from contamination; wherein the gripping elements provide access to the at least one film strip.

These and other features of the invention will be more fully understood from the following description of specific embodiments of the invention taken together with the accompanying drawings.

BRIEF DESCRIPTION OF THE DRAWINGS

Corresponding reference characters indicate corresponding parts throughout the several views of the drawings.

DETAILED DESCRIPTION OF THE INVENTION

Figure 1:
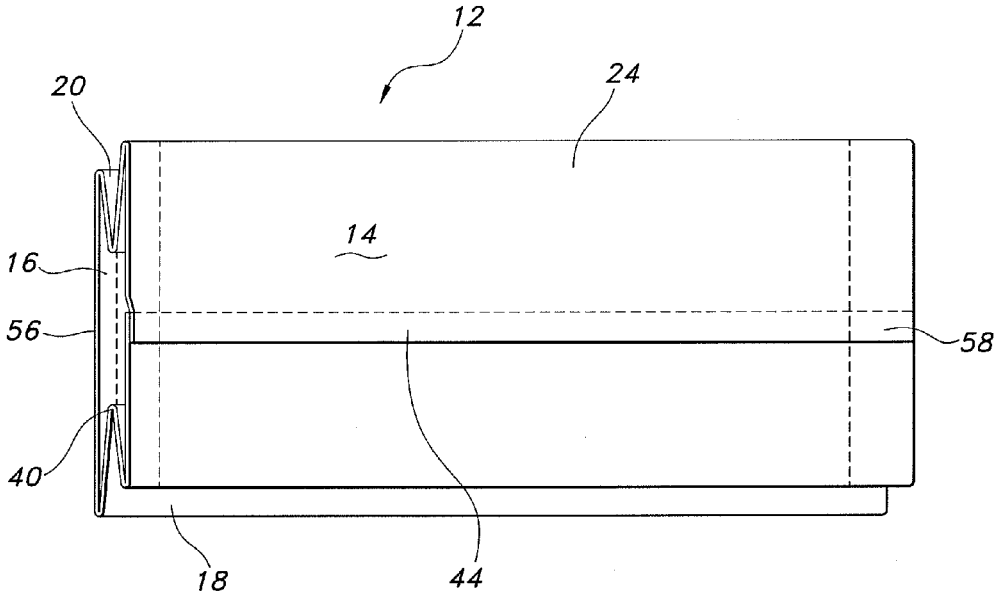
FIG. 1 is a perspective top view of the package structure of the present invention, the package structure being shown as having two ends which include gussets.

The present invention includes a unit assembly 10, a method of manufacturing the unit assembly and a method of dispensing a film strip 50 from a unit assembly 10. References to like numerals denote like parts and may be depicted on one or more of the associated figures. Referring to the Figures, the present invention provides a unit assembly 10 for storing and dispensing a film strip 50. The unit assembly 10 may refer to a package structure 12 which may desirably be configured to retain at least one film strip 50. The unit assembly 10 may include two opposed panels 14, 16, and at least one gusseted side panel 18 disposed between at least a portion of the first and second panels 14, 16.

Figure 5:
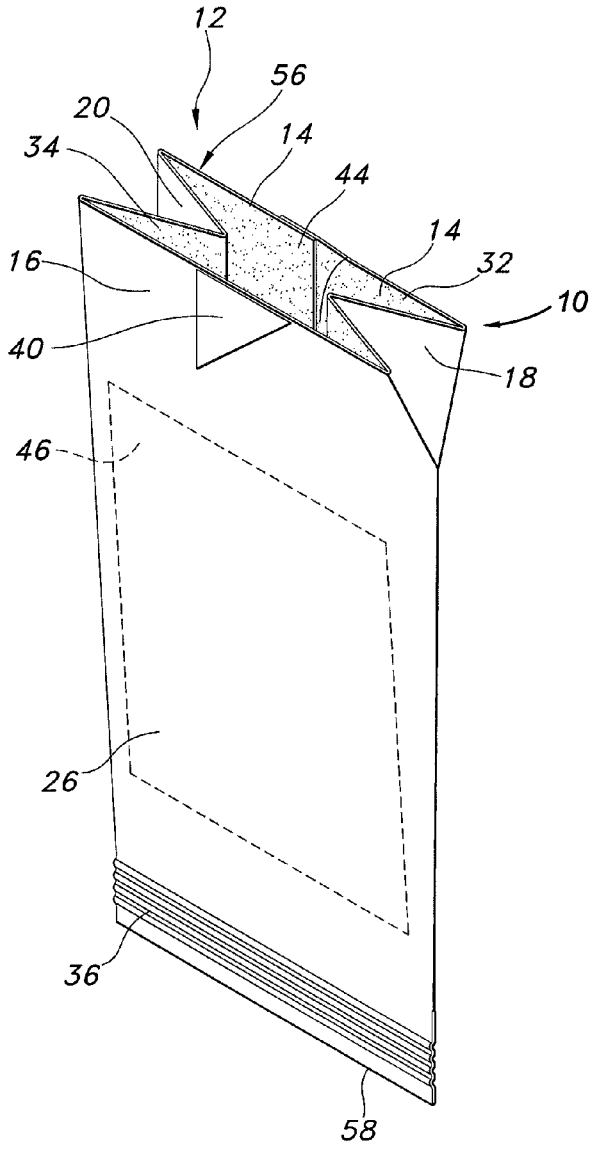
FIG. 5 is a perspective side view of the package structure of FIG. 1, showing the gusset in an open position to provide access to the interior of the package structure.
Figure 6:
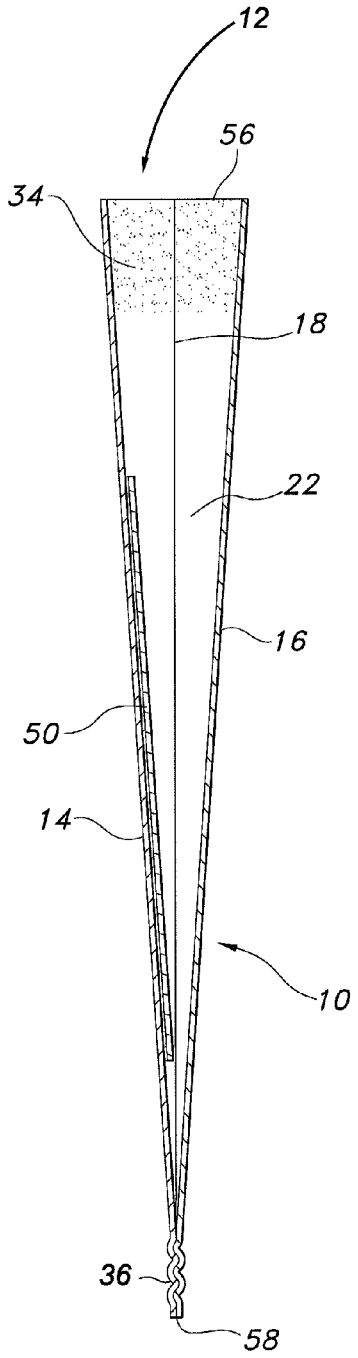
FIG. 6 shows a film strip deposited within the interior of a package structure.
Figure 7:
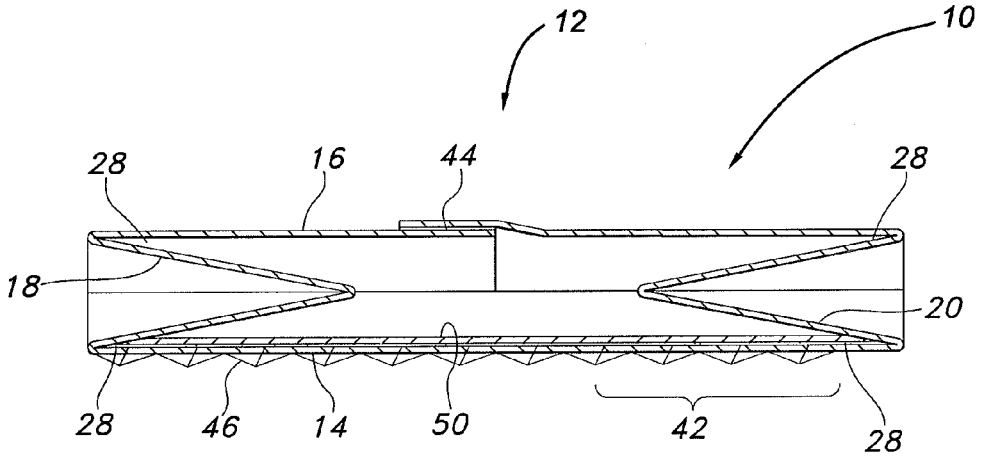
FIG. 7 is a side plan view of an open end of the package structure.
Figure 8A:
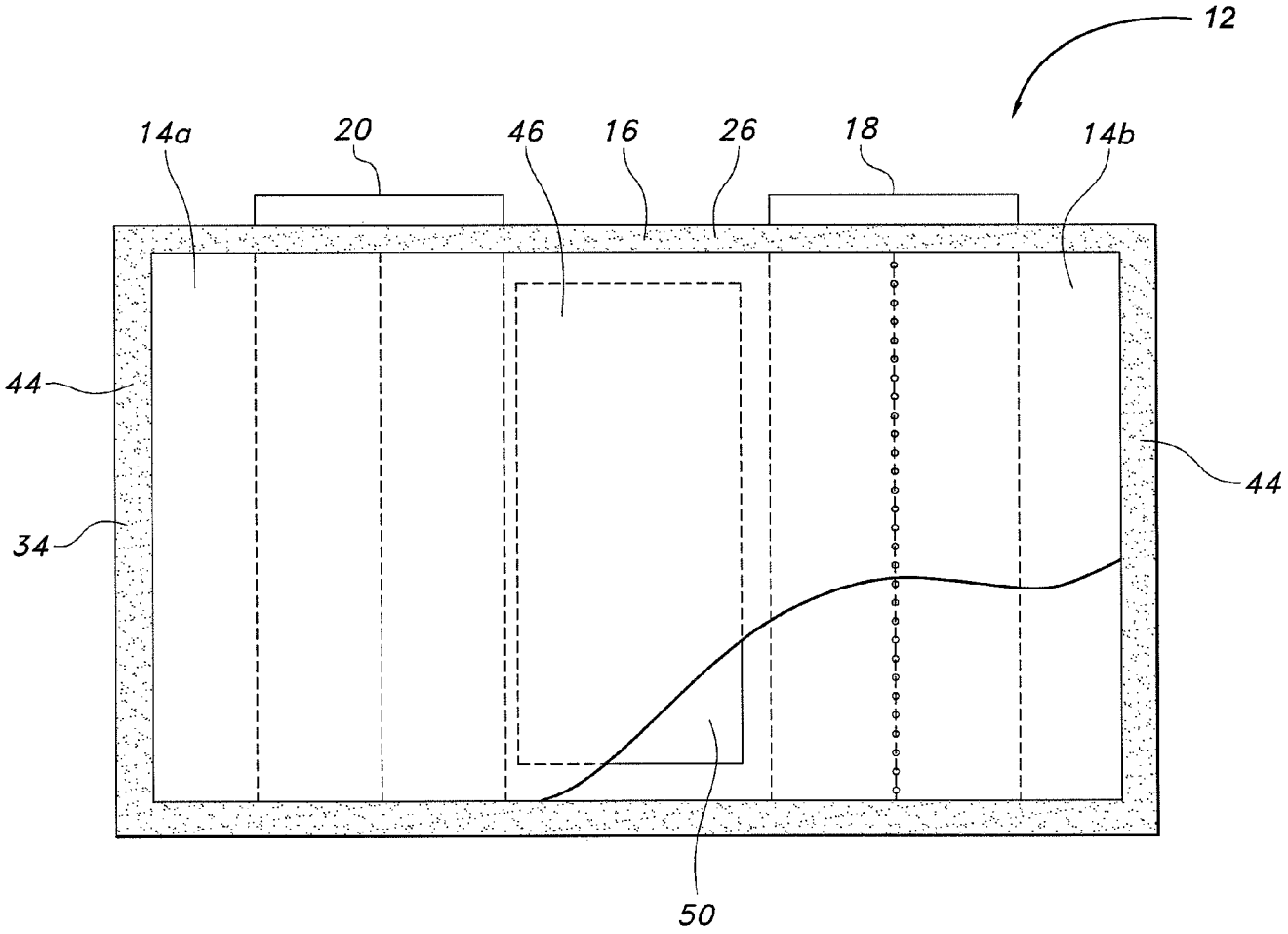
FIG. 8A depicts an embodiment of the packaging material with a folding pattern thereon to form the package structure.
Figure 8B:
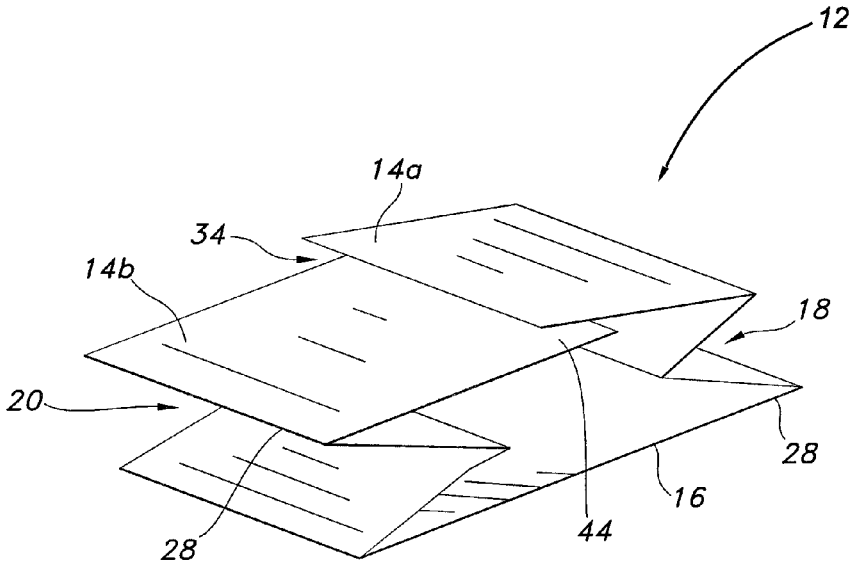
FIG. 8B depicts a perspective end view of the folded pattern of FIG. 8A.
Figure 9A:
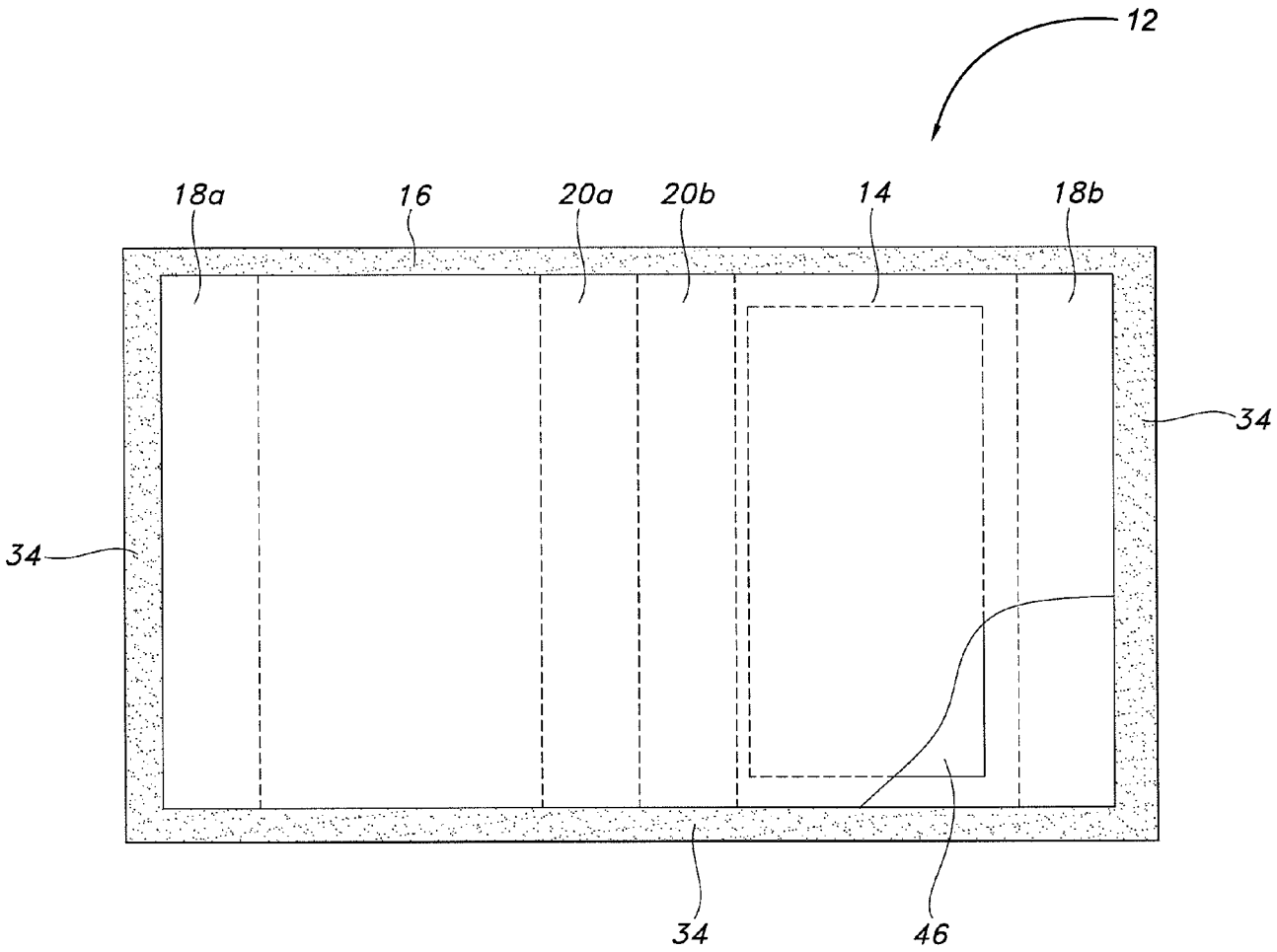
FIG. 9A depicts an embodiment of the packaging material with a folding pattern thereon to form the package structure.
Figure 9B:
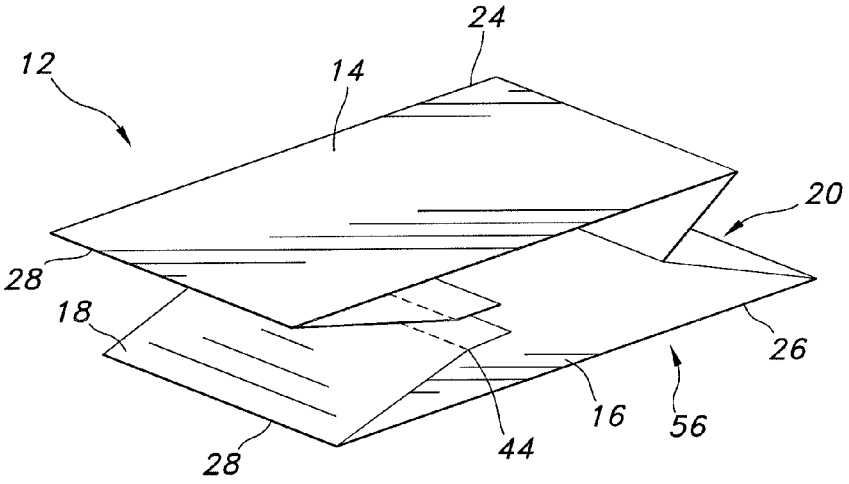
FIG. 9B depicts a perspective end view of the folded pattern of FIG. 9A.

The first panel 14 has a first perimetrical edge 24 and a second panel 16 has a second perimetrical edge 26 as depicted in FIGS. 1 and 5, respectively. The first and second panels 14, 16 may be of a substantially similar size, shape, and dimension such that the first and second panels 14, 16 are substantially opposed to each other in the package structure 12 (see, e.g. FIG. 6). At least one of the first and second panels 14, 16 may desirably have an increased rigidity over the remaining panel, or over the film strip 50 to be retaining within. A semi-rigid 46 quality to at least one panel may advantageously allow the film strip 50 to lie along an inner surface of the semi-rigid panel 46 while the film strip 50 is opened. Such placement of the film strip 50 may contribute to a lower likelihood of bending, breaking, or otherwise damaging the film strip 50 in the opening process. In order to make one of the panels 14, 16 have an increased rigidity over the other panel 16, 14, it is possible to employ multiple layers of a material in the semi-rigid panel 46, while utilizing only a single layer or a thinner layer in the less-rigid panel. Also, it is possible to corrugate at least one of the panels 14, 16 as shown, for example, FIG. 7) in order to impart an increased rigidity on at least one of the panels. Though a particular pattern of corrugation is depicted in FIG. 7, the corrugation panel 42 may be any desired pattern or configuration, and is not limited by the present description.

One or more of the panels, including the first panel 14, second panel 16, and gusseted side panel(s) 18 may be constructed of one or more materials, as may be desired. These materials include various plastics, composites, polymers, foils, papers, laminates, and combinations thereof, as may be desired. Alternative materials known in packaging may also be employed, as may be desired. The package structure 12 may form a unit assembly 10, which encloses and seals at least one film strip 50 therein. Further, the unit assembly 10 of the present invention is preferably a substantially planar configuration that composed of materials that promote a water-tight, air-tight, and contaminant free environment for the film strip 50 as it resides within the cavity of the package structure 12. Further, the packaging structure materials may have beneficial properties and characteristics which promote the integrity of the film strip 50 while it is packaged prior to opening of the unit assembly. More particularly, water, air, contaminants, and other undesirables may be advantageously blocked by the packaging structure 12, the adhesive materials, and the unit assembly 10. Further, the packaging materials may have insulating characteristics to prevent extreme thermal changes from degrading the product (including either extreme heat or cold). It is desirable that the film strip 50 maintain its mechanical, chemical, and physical properties while packaged in said unit assembly 10, in order to promote a long shelf life of the film strip 50.

Figure 2:
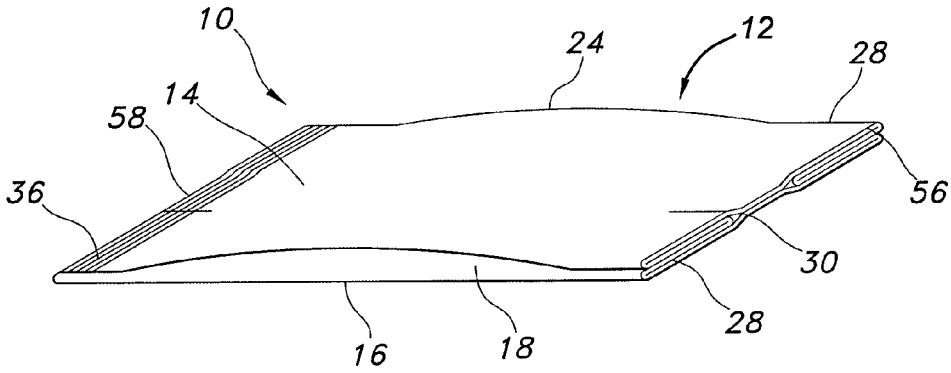
FIG. 2 is a perspective side view of the package structure of FIG. 1.

The at least one gusseted side panel 18 may be disposed between at least a portion of the first and the second panels 14, 16 along a common side thereof. The gusseted side panel 18 may be located along only a portion of the side wall such that along one side of the package structure 12, the first and second panels 14, 16 are attached to one another at one of the ends 58, while the panels 14, 16 are attached to one another through the gusseted side portion 18 along the other end 56 of the package structure 12 (See, e.g. FIG. 5). Alternatively, the gusseted side panel 18 may run along the length of the unit assembly as depicted in FIG. 1, FIG. 2, and FIG. 6. The gusseted side panel 18 is configured to facilitate access to at least one film strip 50 which is stored in a perimetrically sealed, substantially planar cavity 22 within the unit assembly 10.

Referring to FIGS. 5 and 6, the first panel 14, second panel 16, and the at least one gusseted side panel 18 define a package structure 12 having two opposed ends 56, 58, for sealing at least one film strip 50 inside of the unit assembly 10. Thus, the first and second panels 14, 16 define along their respective faces the cavity within which at least one film strip 50 may be enclosed, as shown in FIG. 6.

Figure 4:
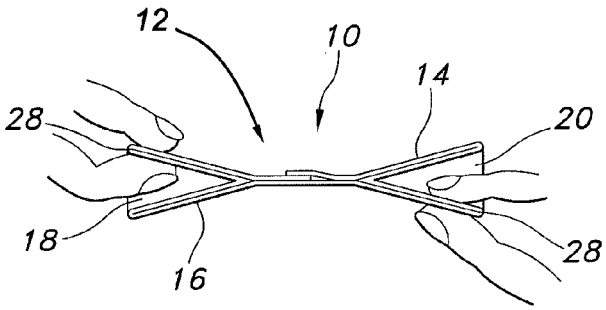
FIG. 4 is a side plan view of an end of the package structure of FIG. 2, being gripped in order to be opened.

The gusseted side panel 18 may operate within the package structure 12 to allow a user to open an end of the unit assembly 10 and have a wide mouthed opening to aid a user in gripping and removing at least one film strip 50 therefrom (e.g. FIG. 7, FIG. 4). That is, the unit assembly 10 of the present invention may be manipulated into an open position in which no tearing of the package structure 12 need take place. As the gusseted side portion is pulled apart to an expanded position, the opened end of the package may benefit from an increase in "open end" circumference or perimeter as compared to a non-gusseted package opening. That is, the gusseted side portion(s) may increase the open portion of the package by 30%, 50%, 100%, etc, as may be desired, in order to provide a large enough perimeter of said open end to allow a user to easily grasp the film strip dosage and remove it from within the package.

Thus, the present invention may allow a user to insert one finger, opposing fingers (e.g. an index finger and a thumb), or multiple fingers in order to grasp and safely remove the film strip from within the unit assembly 10. The user may benefit by not only being able to grip and remove the film strip from the package, but also, the user will benefit from a strikingly larger opening on the unit assembly 10 to visualize the film strip. Further, the gussets provide for a larger opening of the package while promoting efficiency of materials from a packaging use. That is, the entire package size will remain relatively small enough to encase the film strip 50 from contaminants and store it until it is used. However, the gussets 18 provide for ease of opening and retrieval from the package 12 when the film strip 50 is removed. For users with limited dexterity or limited vision, the wide opening that the gusseted side wall provides may allow a user ample opportunity to view, grasp, and remove the film strip 50 from the package structure 12.

The at least one gusseted side panel 18 may be configured to include a gripping element 28. The gripping element 28 may allow a user to grip the unit assembly 10 and apply a pulling force to the unit assembly 10 at the site of the gusseted end 56 of the unit assembly 10 in order to open the unit assembly 10 and access the film strip 50 that is enclosed therein. Desirably, there may be a pair of gusseted side panels 18, 20 that attach the first and second panels 14, 16 to one another at one end of the package assembly 10. In such a manner, there are two possible opposed gripping sites 28 available to a user, as depicted in FIG. 4. The gripping element may include any part of the package structure 12 that may be easily gripped and/or pulled upon by a user, including but not limited to, edges, folds, exterior tabs, and the like. Thus, as shown in FIG. 2, the gusseted side panel 18 creates an end of the unit assembly 10 that has defined gripping elements 28.

A user may grip two folds at the same side and end of the unit assembly 10, i.e. the two folds located adjacent to the gusseted side panel 18. Desirably, as shown in FIG. 4, the gripping elements 28 may be opposed to one another such that a user may grip the elements with their left and right hands simultaneously in order to impart a pulling force across the gripping elements. This pulling force may then result in the end of the unit assembly 10 opening to reveal at least one of the film strips 50 inside. Once the unit assembly 10 is opened, the at least one gusseted side panel 18 aids the user in seeing, gripping, and removing the films strip 50, as the gusseted side panel 18 expands to allow the unit assembly 10 to open at a wide angle.

Once the unit assembly 10 is in an opened position, the unit assembly 10 may further include at least one tab 40 along an end thereof. The tab 40 may be large or small, and may be integral with the package or may be attached thereto by one or more desired means, including gluing, welding, fusing, adhering, and the like. The tab 40 may allow a user to grip the tab 40 with one hand while the unit assembly is in an open position. Then, the user may grip the film strip with their other hand and remove the film strip through the gusseted, widened open end. Examples of the tab 40 may be depicted in FIGS. 3 and 5.

Further, the unit assembly 10 may be configured to house a plurality of film strips 50. In such a configuration, it may be desirable to include an adhesive 34 at the gusseted side portion 18, 20, end 56 of the unit assembly 10 that is resealable 32 in character (e.g. FIG. 5). Thus, the unit assembly may be opened, closed, and reopened to enclose and dispense a plurality of film strips 50 while protecting the remaining film strips 50 within the unit assembly 10 until a user removes one or more film strips for administration. Thus, there may be resealable adhesive 32 material applied to the contact points of the gusseted side panels 18, 20 and the first and second panels 14, 16 (on the inside of the gripping portions 28 and along the contact point of the first and second panels at the end of the package assembly 56) to promote a resealable character.

It should be noted that the gusseted side panels 18, 20 may be either inwardly or outwardly folded in order to create the gripping portions 28. For an outwardly oriented gusseted side panel, the gusseted side panel 18 will extend outward and away from the first and second panels 14, 16 (not shown).

The film strip 50 may further comprise an active within a polymer matrix. After the desired components are combined to form a multi-component matrix, including the polymer, water, and an active or other components as desired, the combination is formed into a film. The film strip 50 may have varying thickness and/or dimension. Various medicaments, pharmaceuticals, nutraceuticals, and other substances and materials may be included thereon or therein in order to dose a desired agent to an individual. Some film strips 50 may have a large surface area (e.g. generally planar surface) to mass ratio, and/or may be subject to adherence with the packaging material(s). As examples, some film strips may be lightweight such that they may have an electrostatic adherence to the packaging material(s) and/or the films may be slightly sticky such that they may tend to stick or adhere to the packaging material(s). In such cases, retrieval of the film strips from the packaging material(s) may be difficult. Thus, the packaging of the present invention, which includes at least one gusseted side panel (18), may allow a user greater and/or easier physical access to the thin film by the user. The gusseted side panel (18) allows the film strip packaging to be opened to a large-mouth or large opening configuration, making the gripping and retrieval of the thin film product easier than with traditional packaging.

Figure 3:
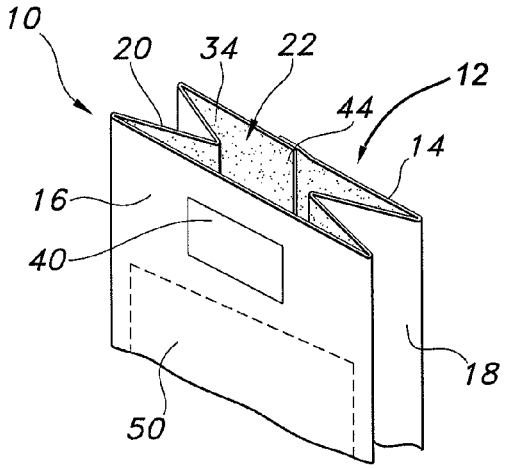
FIG. 3 is a perspective view of an end of the package structure of FIG. 1, the gussets being shown in an open configuration.

As shown in FIG. 1, FIG. 3, and FIG. 5, the package structure 12 may further include an overlap region 44. The overlap region 44 may generally refer to the area where the ends of the sheet of a package structure 12 may be joined in order to create and define the cavity within. Further, it is possible to impart a tearing function to the overlap region 44 in order to provide more than one means of opening the unit assembly 10. The overlap region 44 may be an overlap that has been adhered, bonded, or joined by one or more methods, as may be desired. FIG. 2 depicts one possible embodiment of a unit assembly which includes a pair of gusseted side panels that cooperate to join the first and second panels 14, 16. One end 58 of the unit assembly 10 is closed in a permanent fashion to create a package structure 12 with an inner cavity, an open end for insertion of the film strip 50, and three sides to retain the film strip 50 within the package structure 12 until the completed unit assembly 10 is closed and/or sealed. This end may be adhered to a closed position. Alternatively, the end 58 may be heat sealed or crimped 36 to seal. At the other end 56, the gusseted side panels 18, 20 may be adhered to a closed position. Gripping elements 28 may be defined from a portion of the gusseted panels (18, 20) which may be folded over a portion of the first and/or second panels 14, 16. Thus, each gripping element 28 may have adhesive 34, resealable adhesive 32, or another bonding medium (i.e. heat seal, etc.) between the inner edges of the gripping element 28. Further, there may be a central portion 30 on at least one end 56 of the two ends 56, 58 of the unit assembly. The central portion may further include a seal, defined between the first and second panels (14, 16). Thus, adhesive 34 (or resealable adhesive 32) may be applied along the inner surface at an end of the package structure such that upon folding of the gusseted side panels (18, 20) at an inward position, and closing of the end 56, gripping elements 28 and a center seal may be defined. The unit assembly 10 may lie in a substantially flat, planar configuration, in which the gripping elements 28 may be folded down and retained in-line with the plane of the first and second panels 14, 16. As such, space-saving storage of multiple unit assemblies may be desirably achieved with the present design.

The package structure 12 may be made from one or more possible designs and configurations. For example, different variations of the package structure 12 are shown in FIGS. 8A, 8B, 9A, and 9B. These Figures show possible folding patterns imparted upon the package structure 12 and the three-dimensional perspective view of the folded result before either end is bonded or adhered, and before the film strip 50 is inserted therein. Thus, FIGS. 8A through 9B serve as exemplary, non-limiting designs for the package structure 12 of the present invention. One or more patterns or methods of manufacture may be employed to yield a package structure 12 in accordance with the present invention. At least one film strip 50 may be inserted into the package structure and sealed therein to create the unit assembly 10. The unit assembly 10 may be opened by a user gripping the gripping portions with their hands and applying a pulling force across and end of the unit assembly 10 such that the ends open. This provides access to the planar cavity 22 and the at least one film strip 50 therein.

While the invention has been described by reference to certain preferred embodiments, it should be understood that numerous changes could be made within the spirit and scope of the inventive concept described. Accordingly, it is intended that the invention not be limited to the disclosed embodiments, but that it have the full scope permitted by the language of the following claims.

What is claimed is:

1. A unit assembly comprising:

a package structure comprising:

a first panel;

a second panel;

a top end;

a bottom end;

a first gusseted side panel disposed between said first panel and said second panel along only a portion of the length of a first common side thereof at only the top end of the package structure;

a second gusseted side panel disposed between said first panel and said second panel along only a portion of the length of a second common side thereof at only the top end of the package structure; and a substantially planar cavity;

wherein said first panel and said second panel are substantially opposed to each other;

wherein the first panel comprises an overlap region;

wherein the first panel and second panel are adjoined in contact along the portion of the length of the first common side wherein the first gusseted side panel is not disposed;

wherein the first panel and second panel are adjoined in contact along the portion of the length of the second common side wherein the second gusseted side panel is not disposed;

wherein the length of the first common side wherein the first panel and second panel are adjoined in contact is longer than the length of the first common side wherein the first gusseted side panel is disposed;

wherein the length of the second common side wherein the first panel and second panel are adjoined in contact is longer than the length of the second common side wherein the second gusseted side panel is disposed; and wherein a film strip is stored in the unit assembly.

2. The unit assembly of claim 1, further wherein at least one of said gusseted side panels further comprises a gripping element.

3. The unit assembly of claim 2, wherein said gripping element comprises a resealable adhesive.

4. The unit assembly of claim 2, wherein said gripping element is an exterior tab.

5. The unit assembly of claim 1, further comprising a seal along at least one of said ends.

6. The unit assembly of claim 1, further wherein at least one of said gusseted side panels comprises an inwardly folded side panel.

7. The unit assembly of claim 1, wherein said film strip is retained within said package structure, and wherein said film strip comprises an active within a polymer matrix.

8. The unit assembly of claim 7, further wherein the active comprises a nutraceutical, a pharmaceutical, a bioactive agent, and combinations thereof.

9. The unit assembly of claim 1, wherein said overlap region comprises a seam with adhesive.

10. The unit assembly of claim 1, further wherein the top end and bottom end are closed by one of the following, including: heat sealing, crimping, rolling, bonding, welding, adhering, resealably adhering, and combinations thereof.

11. The unit assembly of claim 1 further comprising an indicia on said package structure.

12. The unit assembly of claim 1, wherein said package structure is comprised of a material selected from the group consisting of: a plastic, a polymer, a foil, a paper, and a combination thereof.

13. The unit assembly of claim 1, further comprising a plurality of film strips.

14. The unit assembly of claim 1, further wherein said package structure is impermeable to contaminants.

15. The unit assembly of claim 1, further wherein at least one of said first panel and said second panel is a semi-rigid surface.

16. The unit assembly of claim 1, further wherein at least one of said first panel and said second panel is at least partially corrugated.

17. The unit assembly of claim 1, further wherein at least one of said ends of said package structure further includes at least one gripping tab thereon.

18. A method of manufacturing a unit assembly for housing a film strip, comprising:

folding a package structure into a configuration having (i) a first panel and a second panel, (ii) a top end and a bottom end, (iii) a first gusseted side panel disposed between said first panel and said second panel along only a portion of a length of a first common side thereof at only the top end of the package structure, and (iv) a second gusseted side panel disposed between said first panel and said second panel along only a portion of a length of a second common side thereof at only the top end of the package structure, wherein said package structure defines a planar cavity therein; and wherein the first panel comprises an overlap region;

inserting at least one film strip into said package structure to define a unit assembly; and closing the unit assembly to enclose the at least one film strip therein to yield gripping elements, wherein said unit assembly is configured to protect the at least one film strip from contamination; and wherein the gripping elements provide access to the at least one film strip;

wherein the at least one film strip is housed within the unit assembly;

wherein the first panel and the second panel are adjoined in contact along the portion of the length of the first common side wherein the first gusseted side panel is not disposed;

wherein the first panel and the second panel are adjoined in contact along the portion of the length of the second common side wherein the second gusseted side panel is not disposed;

wherein the length of the first common side wherein the first panel and second panel are adjoined in contact is longer than the length of the first common side wherein the first gusseted side panel is disposed; and wherein the length of the second common side wherein the first panel and second panel are adjoined in contact is longer than the length of the second common side wherein the second gusseted side panel is disposed.

19. The method of claim 18, wherein the closing step further comprises the step of bonding, sealing, heat sealing, or adhering said package structure to enclose the at least one film strip within the planar cavity therein.

* * * * *